United States Patent [19]

Brenn Albertoni

[11] 4,431,012

[45] Feb. 14, 1984

[54] HAIR-CURLER

[76] Inventor: Gemma Brenn Albertoni, Via Ghiringhelli, 15, Bellinzona, Switzerland

[21] Appl. No.: 364,464

[22] Filed: Apr. 1, 1982

[30] Foreign Application Priority Data

Apr. 15, 1981 [IT] Italy ..... 21182 A/81
Oct. 28, 1981 [IT] Italy ..... 24745 A/81

[51] Int. Cl.[3] ..... A45D 2/00
[52] U.S. Cl. ..... 132/40
[58] Field of Search ..... 132/40, 42, 41, 39

[56] References Cited

U.S. PATENT DOCUMENTS

| | | | |
|---|---|---|---|
| 2,131,600 | 3/1942 | Holden | 132/42 R |
| 3,204,646 | 9/1965 | Chamberlin | 132/42 R |
| 3,314,435 | 4/1967 | Winkler | 132/40 |
| 3,624,749 | 11/1971 | Girard | 132/40 |
| 3,672,493 | 6/1972 | Modrey | 132/39 |
| 3,718,144 | 2/1973 | Jennis | 132/39 |
| 3,960,157 | 6/1976 | Andrews | 132/40 |
| 4,267,851 | 5/1981 | Plaisted | 132/39 |

*Primary Examiner*—Gregory E. McNeill
*Attorney, Agent, or Firm*—Wenderoth, Lind & Ponack

[57] ABSTRACT

A hair-curler includes an inner tubular support member and an outer coating formed of a fabric carrying a plurality of thread-like elements extending therefrom for hooking and retaining the hair of a user. In order to have optimal use conditions in all positions on the head of the user and, if desired, a hair-curler which may be heated, the outer coating is in the form of a sheath which is elastically deformable in all directions. The inner support member is formed of a body such that the body-coating assembly will exhibit properties of at least local flexibility and elastic deformability in order to permit the best adaptability to the head of the user.

10 Claims, 12 Drawing Figures

HAIR-CURLER

BACKGROUND OF THE INVENTION

1. Field of the Invention

This invention relates to a hair-curler of the kind comprising a substantially tubular inner support member and an outer coating formed of a fabric carrying a plurality of substantially thread-like elements extending therefrom forming elements for hooking and retaining the hair of a user.

2. Description of the Prior Art

Hair-curlers of the above mentioned type are already well known and used. They are based on a fabric in which the hooking elements are formed of synthetic filaments extending from the fabric and forming at their ends hooks mushroom-caps or similar retaining elements. These elements are usually arranged in parallel rows, spaced apart by apertured regions, the apertures of which, in cooperation with the apertures provided in the support member, provide for ventilation of the hair-curler. The hair retaining and ventilation properties of such hair-curlers are dependent on a greater or lesser mutual distance between the parallel rows of hooks, which are circumferentially or longitudinally arranged with respect to the hair-curler axis. Therefore, by arranging the rows of hooking elements closer to each other a better retaining action is obtained, but this is detrimental to the curler ventilation and can lead to a greater danger of tearing of the hair of the user.

Furthermore, the known hair-curlers do not permit a correct adaptability of the curler surface to the configuration of the head of the user, in any position thereon. In fact, with these curlers, even if a very flexible inner support member is provided, the outer coating will not be capable of following the different configurations of the support member and excessive thickening or thinning out of the hooking elements on the outer coating will occur.

SUMMARY OF THE INVENTION

With the above discussion in mind, it is an object of the present invention to provide a new hair-curler capable of providing in all situations optimal hair retaining and ventilation conditions together with good flexibility and adaptability to the conformation of the head of the user.

It is another object of the present invention to provide a new hair-curler permitting a better hair retaining action and an easier hair unwinding action by providing an outer coating having relatively few hooking elements and therefore a greater spacing between the parallel rows thereof in order to improve ventilation conditions.

It is a further object of the present invention to provide a new hair-curler of the "pressure adhesive" type, which can achieve a universal application, i.e. which, in addition to the conventional use, permits it to be used as a curler provided with a heating body or to be associated with a heating or vaporizing apparatus.

In order to attain these and other objects the invention provides a hair-curler of the above mentioned type, wherein the outer coating is in the form of a cylindrical sheath which is elastically deformable in all directions and wherein the inner support member is formed of a support body, the body-coating assembly having at least locally an inherent flexibility and elastic deformability properties in order to adapt the hair-curler to the head of the user.

DESCRIPTION OF THE PREFERRED EMBODIMENTS

Figure 1:
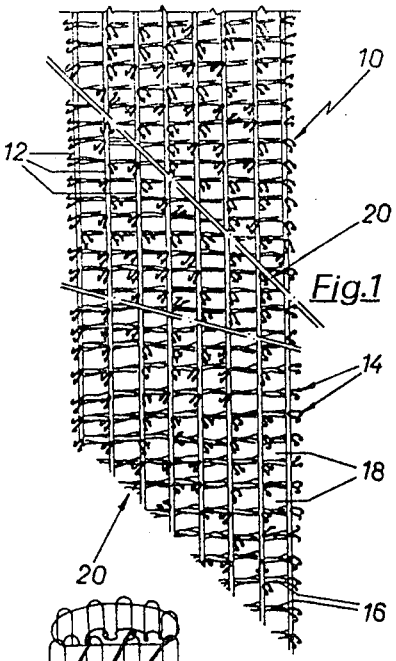
FIG. 1 is a diagrammatic plan view of a fabric from which the hair-curler coating of the invention is obtained.

Referring now to the drawings, FIG. 1 shows a fabric 10 formed of a plurality of parallel rows 12, each carrying a plurality of bristles or filaments 14 extending in a direction substantially perpendicular to the fabric and in the form of hooks, mushroom caps or the like, in order to form hooking elements. Provided between the rows 12 are connecting portions 16, which leave wide apertures 18 for air flow from one side to the other side of the fabric.

Figure 2:
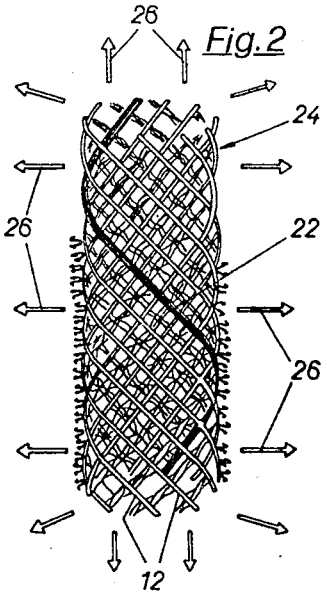
FIG. 2 is a perspective front view of the coating obtained from the fabric of FIG. 1.

This fabric 10 is cut along inclined lines 20 and the so obtained length is helically wound, with the opposite edges being retained as indicated by 22 in FIG. 2. The hooking element rows 12 are helically wound so that each row will cover at least a half-pitch of the helix and will extend along the longitudinal height of a coating 24 formed by the helically wound fabric (FIG. 2). Therefore, the coating 24 will exhibit elastic deformability properties in all directions, as indicated by the arrows 26 in FIG. 2, as well as wide ventilation apertures and a very high hair retaining action.

Figure 3:
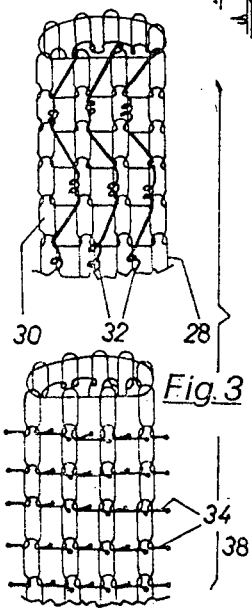
FIG. 3 is a diagrammatic view of another possible fabric type for hair-curlers, represented before and after a hooking element formation.

In FIG. 3 there is shown another kind of knitted fabric 28 forming a tubular element and including ventilation apertures 30.

During the manufacture of this fabric a rigid synthetic filament weft 32 is inserted, forming loops extending from the fabric, which then are cut in order to form hooking elements 34 having the shape of a mushroom cap, a ball or the like (see the lower portion of FIG. 3).

The above mentioned properties of the illustrated coatings and particularly their elastic deformability enable them to be coupled to inner support members of different types, which impart at the same time to the hair curler an at least limited deformability for adapting it to the head of the user.

Figure 4:
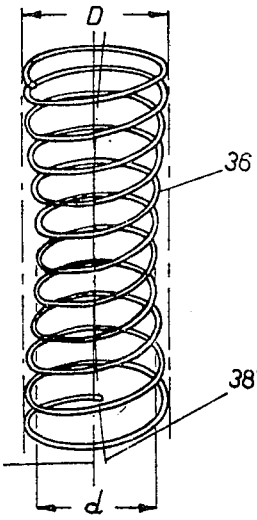
FIG. 4 is a perspective view of a support member to which a coating of FIG. 2 or 3 can be applied.

For example, in FIG. 4 there is shown a support member formed of a biconical coiled spring 36 having a greatest diameter D and a smallest diameter d, as well as an axis 38 which can be curved, f.i. as indicated in 38', due to a deformation of the entire support member in order to adapt it to the particular conformation of the head of the user to which the hair-curler carrying this support member will be applied.

Figure 5:
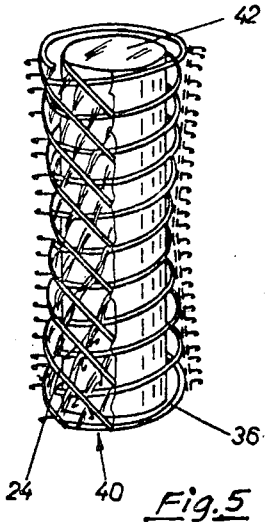
FIG. 5 is a perspective view with broken away portions of a curler comprising the support member of FIG. 4 and the coating of FIG. 2.

Applied on this support member 36 is a coating, for example the coating 24 illustrated in FIG. 2, which has a smaller inner diameter than the greatest diameter D of the support spring 36 before the support member is inserted. The so formed hair-curler, illustrated in FIG. 5, will exhibit a very high adaptability to the conformation of the head of the user, since it can be deformed while maintaining its good hooking and retaining properties because the coating follows without difficulties any deformation of spring 36. Of course, the same advantageous properties can be obtained with a coating as illustrated in FIG. 3.

The hair retaining action is so good that it becomes possible to associate a hair-curler to a well known cylindrical heating body 42 without the need for additional outer locking elements between the curler and hair, notwithstanding the light assembly weight.

The advantages of the invention can otherwise be attained by using many different types of support members, provided that the hair-curler assembly has at least a free deformable region. For example, the spring 36 can be cylindrical in shape or the hair-curler can be formed of the heating body 42 only, with the coating 24 extending on the sides thereof, or else the support member can be formed of a semirigid thick filament structure inserted into the sheath during its manufacturing operation.

Figure 6:
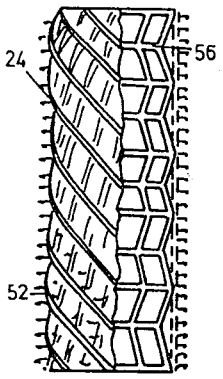
FIGS. 6 through 11 are front views, with broken away portions, of other possible embodiments of hair-curlers.

In FIG. 6 there is shown another embodiment 52 having a coating 24 associated to a cylindrical or biconical support member 56 having an accordion shape and a reticulated structure, e.g. of plastic deformable and flexible material.

Figure 7:
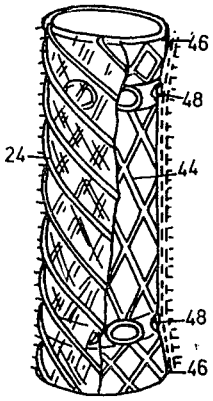

The hair-curler shown in FIG. 7 comprises, in addition to the sheath 24, a support member formed of a center cylindrical portion 44 which is rigid and well ventilated and connected to a pair of end portions 46 having a frustoconical shape. The components 44 and 46 are locked by means of small extensible and compressible rings 48 which impart to the hair-curler the desired properties of local elastic deformability. Rings 48 can be also eliminated, thereby leaving the possibility of a reciprocal orientation between the components 44 and 46.

Figure 8:
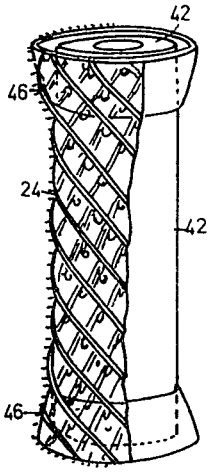

The embodiment shown in FIG. 8 includes a pair of frustoconical components 46 corresponding to the components of FIG. 7 and secured to the ends of the sheath 24. The center portion of the sheath forms the seat for a heating body 42 or any other support member. The greater width of the components 46 with respect to the body of the curler 42 permits the desired movability thereof to be achieved.

Figure 9:
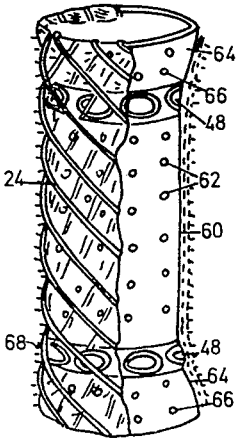
Figure 12:
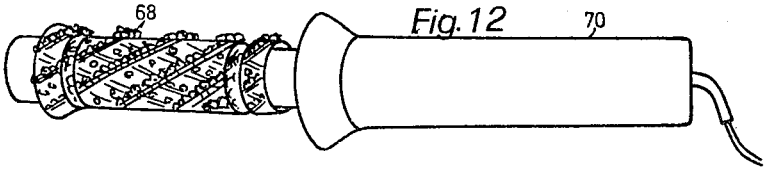
FIG. 12 is a diagrammatic view showing the hair-curler of FIG. 9 as applied to a heating apparatus.

The embodiment shown in FIG. 9 includes again a cylindrical portion 60, possibly provided with holes 62 and two cylindrical or conical portions 64, possibly provided with holes 66. These components can be separated from each other and then kept together by the outer sheath 24 only, or connected to each other by means of small rings of the type indicated at 48 in FIG. 7. The components 60 and 64 are made of a material adapted to trap heat and/or to adsorb heat quickly from a heat source, e.g. a metallic material. This type curler can be provided as indicated at 68 in FIG. 12 in association with a heating apparatus 70 and/or steam or hot air generating apparatus. The relatively large apertures of the sheath permit the hair to be adhered to the support member, thereby adsorbing the heat therefrom.

Figure 10:
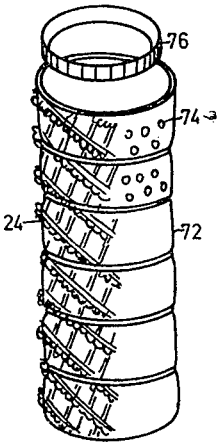

Another embodiment wich can be made of a metallic material is shown in FIG. 10, wherein the support member is cylindrical in shape and formed of a plurality of annular components 72 possibly provided with holes 74, which are articulated to each other in any suitable manner and which are kept in an operative condition by the sheath 24 secured by means of rings 76. This support member can also be formed of a spirally wound metallic strip, with the turns being freely deformable with respect to each other, e.g. as a conventional shower flexible pipe.

Figure 11:
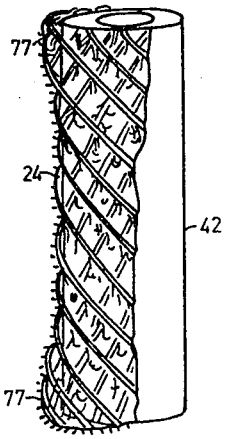

In FIG. 11 there is shown an embodiment similar to that of FIG. 8, wherein conical end portions 77 of the sheath 24 are obtained by hot permanent deformation or the like of the sheath 24. The inner support member 52 can be a heating body or not and can have a length corresponding to or smaller than that of the sheath 24.

I claim:

1. A hair curler comprising:

an outer cover having a generally cylindrical configuration and formed of a fabric having extending outwardly therefrom a plurality of thread-like bristles each having a shaped head for hooking and retaining hair;

an inner support member positioned within said outer cover and defining a generally tubular support therefor, said support member having radial open areas for providing ventilation for hair wrapped around and hooked by said outer cover; and said outer cover being elastically deformable in all directions, and said inner support member being elastically deformable at least at local areas thereof, such that the assembly of said outer cover and said inner support member is elastically deformable to conform to the shape of the head of the user of said curler.

2. A hair curler as claimed in claim 1, wherein said outer cover comprises woven fabric having non-woven areas forming open radial ventilation passages and having parallel rows of said thread-like bristles, and said fabric is cut in directions diagonal to said rows and helically wound on said inner support member to form a sheath with said rows extending helically.

3. A hair curler as claimed in claim 1, wherein opposite axial end portions of said outer cover are generally frusto-conical in configuration and widen axially outwardly.

4. A hair curler as claimed in claim 1, wherein said inner support member has opposite axial end portions of frusto-conical configuration widening axially outwardly.

5. A hair curler as claimed in claim 4, wherein said inner support member comprises a central cylindrical element and opposite end elements of frusto-conical configuration.

6. A hair curler as claimed in claim 5, wherein said elements are elastically deformable.

7. A hair curler as claimed in claim 5, wherein said elements are movable with respect to each other, such that said support member as a whole is locally elastically deformable.

8. A hair curler as claimed in claim 5, wherein said elements are joined by means of flexible ring-shaped members.

9. A hair curler as claimed in claim 4, wherein said support member comprises opposite end elements of frusto-conical configuration, said end elements being spaced to define an open central area adapted to be supported by a separate heating body.

10. A hair curler as claimed in claim 1, wherein said inner support member comprises a plurality of axially aligned, structurally separate annular elements which are movable with respect to each other.

* * * * *